US005650587A

United States Patent [19]

James et al.

[11] Patent Number: 5,650,587

[45] Date of Patent: Jul. 22, 1997

[54] RECOIL SYSTEM

[75] Inventors: David John James, Basford, England; Martin Edwy Buttolph, Newport, Vt.

[73] Assignee: Royal Ordnance plc, Chorley, England

[21] Appl. No.: 510,648

[22] Filed: Aug. 3, 1995

[30] Foreign Application Priority Data

Aug. 4, 1994 [GB] United Kingdom ..... 9415799

[51] Int. Cl.[6] ..... F41A 25/04

[52] U.S. Cl. ..... 89/43.02; 89/43.01

[58] Field of Search ..... 89/43.02, 43.01

[56] References Cited

U.S. PATENT DOCUMENTS

| | | | |
|---|---|---|---|
| 2,397,188 | 3/1946 | Magrum et al. | 39/43.02 |
| 3,130,640 | 4/1964 | Magnuson | 89/43.02 |

FOREIGN PATENT DOCUMENTS

| | | |
|---|---|---|
| 362138 | 6/1906 | France . |
| 1425261 | 4/1966 | France . |
| 160189 | 6/1905 | Germany . |
| 135882 | 1/1920 | United Kingdom . |
| 89/06778 | 7/1989 | WIPO . |
| WO89/06778 | 7/1989 | WIPO . |

*Primary Examiner*—Michael J. Carone
*Assistant Examiner*—Matthew J. Lattig
*Attorney, Agent, or Firm*—Nixon & Vanderhye P.C.

[57] ABSTRACT

A recoil system for field-type guns automatically adjusts the recoil distance of the barrel according to the angle of elevation of the gun barrel relative to the ground. The system includes a recoil cylinder in fixed relationship to the gun barrel and a piston rod operably connected to a two-art piston valve within the cylinder. The rotational position of one of the valve parts is controlled by the angular position of the piston rod about its axis and the rotation position of the second valve part is controlled by its axial piston within the recoil cylinder bore. Fluid flow orifi are defined between the first and second valve part, the area of the orifi being determined by the rotational positions of the two valve parts relative to each other. As barrel elevation is increased, the piston rod is rotated via a camming device which is itself moved by a tooth riding in a non-axial and non-linear slot in the camming device. The higher the barrel elevation, the smaller the orifi area defined between the two valve parts and the shorter the recoil distance allowed before fluid flow is terminated and barrel recoil arrested.

24 Claims, 11 Drawing Sheets

RECOIL SYSTEM

BACKGROUND OF THE INVENTION

1. Field of Invention

The present invention relates to a recoil system for guns such as field guns, howitzers and gun-howitzers and particularly, to a recoil system where the recoil distance is automatically adjusted according to the angle of barrel elevation.

2. Description of Prior Art

A problem which exists with field-type guns such as towed howitzers for example, is that of stability under recoil conditions when firing rounds at low angles of trajectory. Traditionally, high gun masses have minimized this problem in that the higher the weight of the gun, the more stable it tends to be under firing and recoil conditions. However, more recently and especially in the case of larger guns such as, for example, 155 mm towed howitzers, it has become increasingly desirable to transport the gun by helicopter in the interests of improved mobility and response time. The objectives of improved stability through increased mass and improved mobility by helicopter are mutually incompatible.

International patent application published under number WO89/06778 describes a lightweight weapon system having a recoil system which effectively increases the apparent weight of the weapon under firing and recoil conditions. The apparent weight increase is effected by causing the gun barrel and recoil mass to recoil along a curvilinear path in a rearwardly and upwardly direction. Two sets of curvilinear tracks are provided such that the ordnance in its full recoil position is substantially parallel to and above the original ordnance position prior to firing. In this manner, it is possible to make a stable and ergonomically acceptable lightweight weapon from lightweight materials such as titanium and aluminium alloys whereas before, conventional steel materials were used.

The term "ordnance" includes the barrel, breech, muzzle brake of the weapon.

However, other problems remain to be solved in that whilst a relatively long recoil distance may be employed when the gun is firing at low barrel elevations to reduce the recoil force and destabilizing moment, a relatively much shorter recoil distance is advisable when the gun is used at high angles of barrel elevation in order that the breech of the gun does not hit the ground. In the past such problems have been overcome by digging recoil pits into which the gun breech may recoil. Recoil pits are undesirable in that they take time to prepare so extending the time taken to put the weapon into action.

Proposals have been made in the past to shorten the recoil distance by providing mechanisms which are automatically linked to the angle of elevation of the barrel. Known recoil controlling mechanisms employ a hydro-pneumatic cylinder fixed to the ordnance and forming part of the recoil mass, a piston and valve assembly being provided in the cylinder and linked by a piston rod to a strong fixing point on the cradle relative to which the barrel moves during recoil during firing. Under recoil conditions, a high pressure of up to 8,000 to 9,000 p.s.i. can be developed in the recoil cylinder in, for example, a 155 mm howitzer weapon. This pressure is applied to a valve, within the cylinder, which is adjusted by rotation of the piston rod which is itself linked by a system of cams, bellcranks and pushrods to the gun carriage relative to which the barrel rotates during angle of elevation changes. As a result of the high hydraulic pressure generated in the recoil cylinder during firing, a torque is generated on the recoil brake piston rod which generates loads in the linkages between the piston rod and carriage which adjust the piston rod rotation. These loads lead to high rates of wear together with actual distortion of the linkage during firing. Such wear and distortion inevitably results in poor control of orifice size and consequential poor control of the recoil pressure and recoil distance and in the worst case may result in component failure and the gun breech hitting the ground.

It must be understood that, that for the same charge, substantially the same recoil energy must be dissipated whether the gun is being fired at a low angle of elevation where a relatively long recoil distance is available or at a high angle of elevation where a relatively short recoil distance is available. Thus, the pressure generated in the recoil cylinder at high angles of barrel elevation are greater than those at low angles of barrel elevation. Higher recoil pressure corresponds to higher recoil force.

SUMMARY OF THE INVENTION

It is an object of the present invention to provide a recoil system where the recoil distance is automatically, reliably and accurately controlled according to the barrel elevation.

According to the present invention there is provided a recoil system for controlling the recoil distance of a gun barrel according to angle of elevation of the barrel, the barrel following a curvilinear recoil path and the barrel having breech means at one end and a muzzle at the other end, the barrel being movably supported during recoil travel on a cradle adjacent its breech end by curvilinear track means and by bearing means intermediate the breech means and the muzzle, the cradle being supported on carriage means such that the angle of elevation of the barrel may be changed; the recoil system comprising a recoil cylinder in fixed relationship to the barrel and movable therewith; valve means within said recoil cylinder, said valve means being adjustable so as to vary the area of an orifice through which a fluid is forced under recoil conditions; one end of a piston rod operably connected to said valve means so as to cause fluid to pass through said orifice under recoil travel; the remote end of said piston rod being maintained in a substantially axially stationary position relative to said cradle; said piston rod being controllably rotatable about its axis; part of said piston rod being situated outside said recoil cylinder and being operably connected to camming means for controlling the rotational position of the piston rod and hence said valve means orifice area; said camming means having its position determined by control means, said control means being positionally responsive in the axial direction, relative to said cradle, to barrel elevation and preventing movement of said camming means during recoil movement; and means associated with said recoil cylinder to further control the area of said orifice in response to recoil distance.

Preferably, the bearing means intermediate the breech end and muzzle is a spherical bearing in which a cylindrical portion of the barrel slides during recoil movement. The bearing may be located at the front end of the cradle and be rotationally movable relative to the cradle. Alternatively, a cylindrical bearing supported on trunnions, for example, which are transversely pivoted relative to the cradle may be employed, the barrel again being slidable in the bearing.

The valve means may be axially movable relative to the recoil cylinder, and may comprise a first valve portion, the position of which is controlled by the rotational position of the piston rod; and a second valve portion rotatable relative to the first valve portion and having its rotational position dictated by its axial position in the recoil cylinder. The relative rotational positions of the first and second valve portions control the area of the fluid flow orifice therebetween.

The second valve portion may have pegs protruding radially from the circumference thereof, said pegs slidably engaging with helically formed grooves in the bore of the recoil cylinder such that the longitudinal axial position of the second valve portion in the recoil cylinder dictates its rotational position relative to the first valve portion.

The valve means may be associated with a piston member but free to rotate relative thereto subject to the rotational constraints of the piston rod on the first valve portion and on the peg and groove arrangement, for example, in the case of the second valve portion. However, the valve members themselves may effectively constitute the piston by which fluid is forced through the orifice.

Due to the action of the camming means, the rotational position of which is controlled in accordance with barrel elevation, the initial position of the first valve portion is controlled, and hence the initial area of the orifice between the first and second valve portions is fixed prior to firing. The higher the angle of barrel elevation, the smaller the initial orifice area. Thus, the initial resistance to fluid flow through the orifice is greater the higher the barrel elevation, and the sooner the orifice area is closed off by rotation of the second valve portion as it travels axially in the recoil cylinder during recoil motion. When the orifice area is closed off entirely, the recoil motion of the barrel ceases. Conversely, at low angles of barrel elevation, the initial orifice area is relatively great and resistance to fluid flow is less. Therefore, the second valve member is allowed to travel further in the recoil cylinder before the orifice area is closed off terminating recoil movement.

The piston rod may be fixed at its end remote from the valve means by bearing means fixed on a point to the cradle independent of the barrel pivot, for example, the bearing means allowing a small degree of rotational movement relative to the cradle. During recoil movement of the barrel during firing, the piston rod slides relative to the recoil cylinder; because the barrel does not move in a motion where the barrel axis is at all times parallel to itself and to the cradle, there is slight bending of the piston rod since it is supported at three points, these points being the valve means/piston, the gland seal where the piston exits the recoil cylinder and the fixing at the remote end of the piston rod adjacent the front of the cradle. Since these three points do not stay in linear relationship during recoil motion, the piston rod tends to bend about the gland seal which is intermediate the piston and the fixing at the remote end of the piston rod.

In one embodiment of the present invention, the camming means may comprise a generally cylindrical member in fixed relationship to the piston rod. The member having, for example, a groove therein which defines a non-linear and non-axial path relative to the piston rod. The rotational position of the camming means, and hence the piston rod and first valve portion may be controlled by means such as a rigid tooth, for example, which engages with the groove and is axially movable in a predetermined manner relative to the groove. Thus, the axial position of the tooth in the groove determines the degree of rotation of the piston rod. Furthermore, the precise form of the non-axial groove may be changed so as to control the degree of piston rod rotation with barrel elevation. The rigid tooth may, for example, be mounted on a yoke member which surrounds the camming means, the yoke member being pivotally connected to the cradle, for example, and constrained to move in the axial direction relative to the piston rod under the action of a linkage between the carriage and the barrel, the linkage changing the axial position of the rigid tooth member in accordance with barrel elevation.

Clearly, the groove in the camming means may be changed to, for example, a ridge having a non-linear form, such a ridge cooperating with a member having a groove of cooperating form.

In a second embodiment of the present invention, the camming means may comprise a cam plate member having a non-linear cam track profile, the cam plate member being slidably mounted with respect to a cradle side rail, such as on the inner face thereof for example. The axial position of the cam plate member is dictated by the barrel elevational position. The control means may comprise a lever arm having a pivot intermediate its two ends. A first end of the lever arm may have cam track follower means adapted to cooperate with and follow the profile of the cam track of the cam plate member. The second end of the lever arm may be adapted to cooperate with crank arm means which are in fixed relationship to the piston rod. Up or down movement of the lever arm causes a rotational movement of the piston rod according to the degree of elevation of the barrel. The action of the piston rod on and the operation of the valve means is identical to that of the first embodiment.

A particular advantage of the present invention is that resistance to rotation of the piston rod caused by hydraulic pressure on the side face of the orifice in the first valve portion during recoil conditions after firing is greatly increased. Therefore, the reliability, controllability and accuracy of the recoil distance with varying barrel elevation is also greatly improved. The rotational load is now borne directly by the cooperation of the camming means rod and the means to control rotational position of the piston rod; not, on a relatively flexible linkage system having many pivots, bellcranks and pushrods which may wear and through which motion may be lost.

The linkage between the carriage and the means for controlling the rotational position of the camming means in accordance with barrel elevation may still be a system of bellcranks and pushrods. However, the important distinction in the present invention is that this system does not bear the rotational force imposed by the hydraulic pressure in the recoil cylinder during recoil conditions and at the same time there is negligible back-driving of the linkage as the recoil piston rod pivots during curvilinear recoil.

BRIEF DESCRIPTION OF THE DRAWINGS

In order that the present invention may be more fully understood, an example will now be described with reference to the accompanying drawings, of which.

DETAILED DESCRIPTION OF PREFERRED EMBODIMENTS

Figure 1:
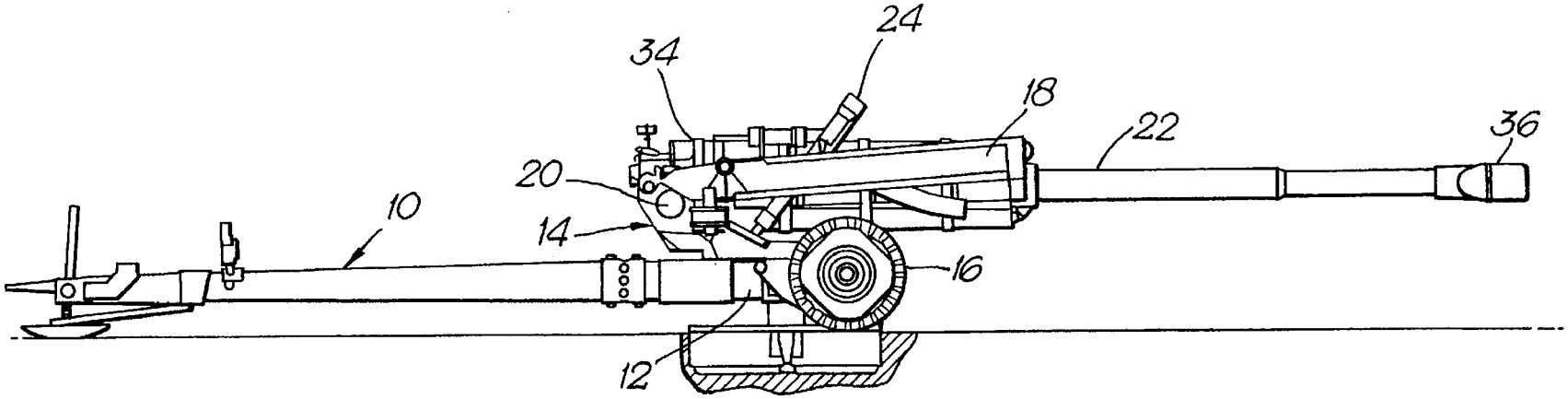
FIG. 1 shows a side elevation of a 155 mm howitzer-type gun employing the present invention.

Referring now to FIGS. 1 to 11 of the drawings and where the same features are denoted by common reference numerals.

Figure 2:
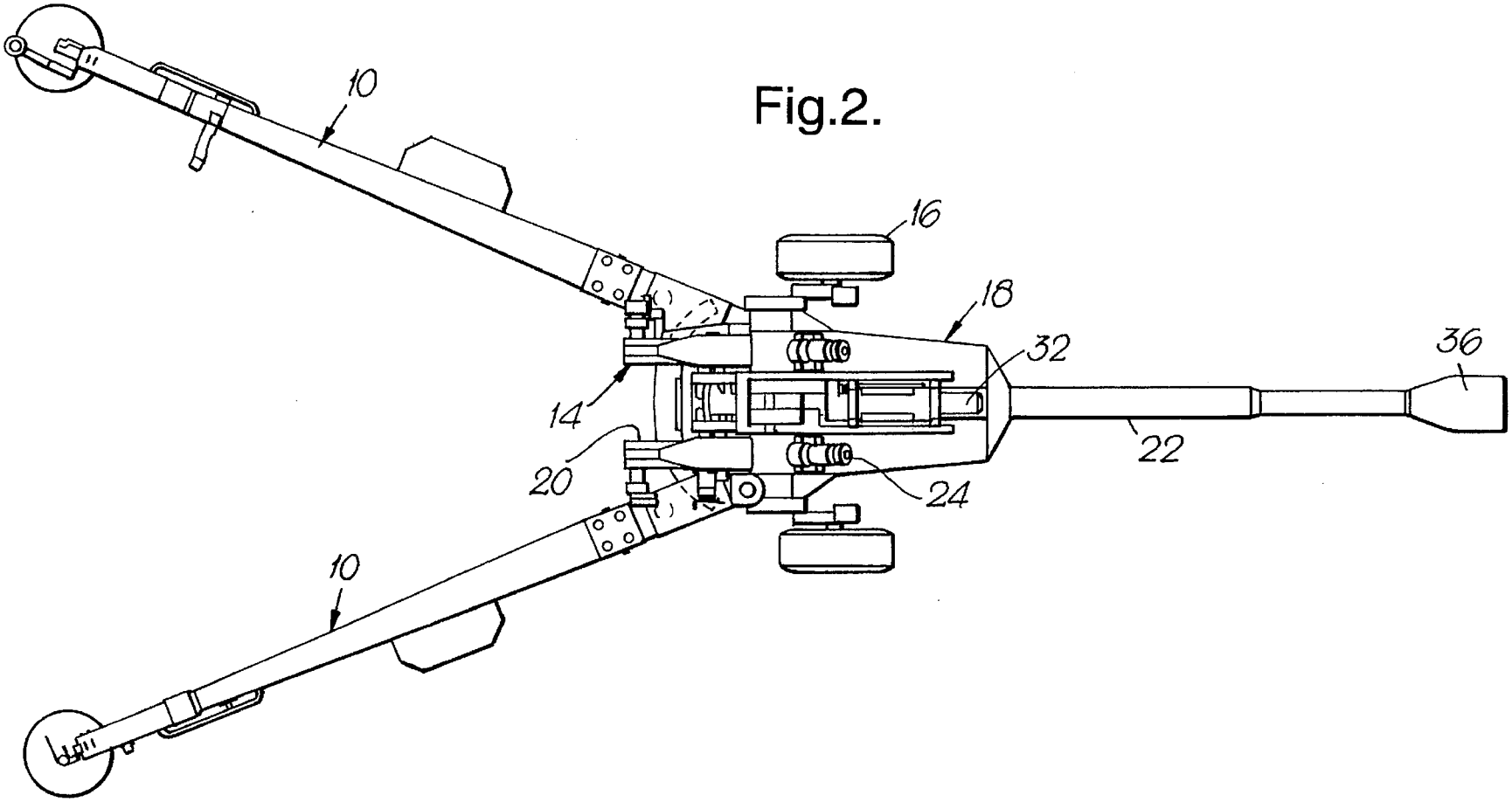
FIG. 2 shows a vertical plan view of the gun shown in FIG. 1.
Figure 3:
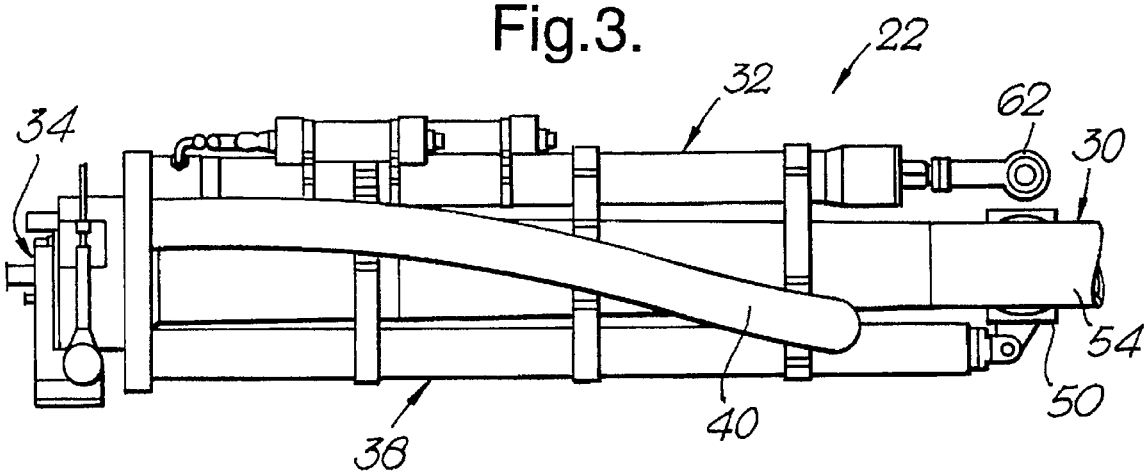
FIG. 3 shows a side elevation of the breech end of the barrel and recoil cylinder.
Figure 4A:
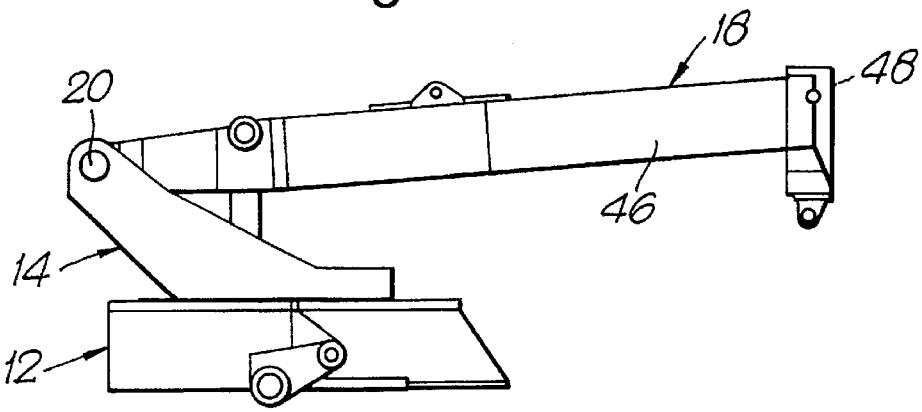
FIGS. 4A and 4B show a side elevation of part of the lower carriage, cradle and front bearing and a plan view thereof, respectively.
Figure 4B:
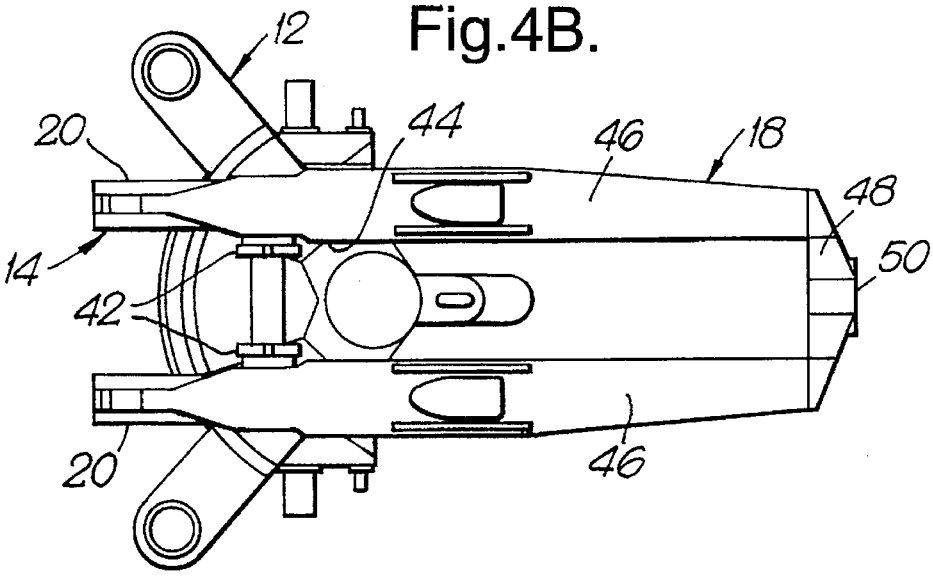
Figure 5:
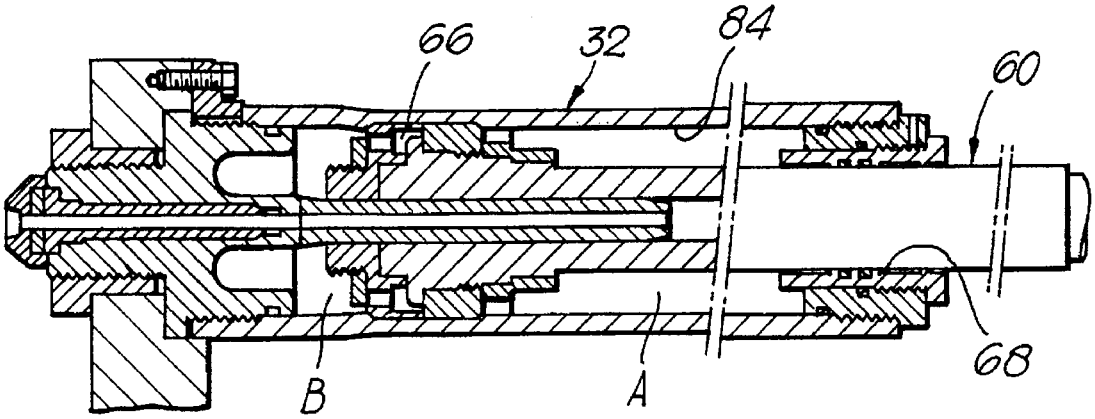
FIG. 5 shows a cross section through the recoil cylinder and part of the piston rod.
Figure 6:
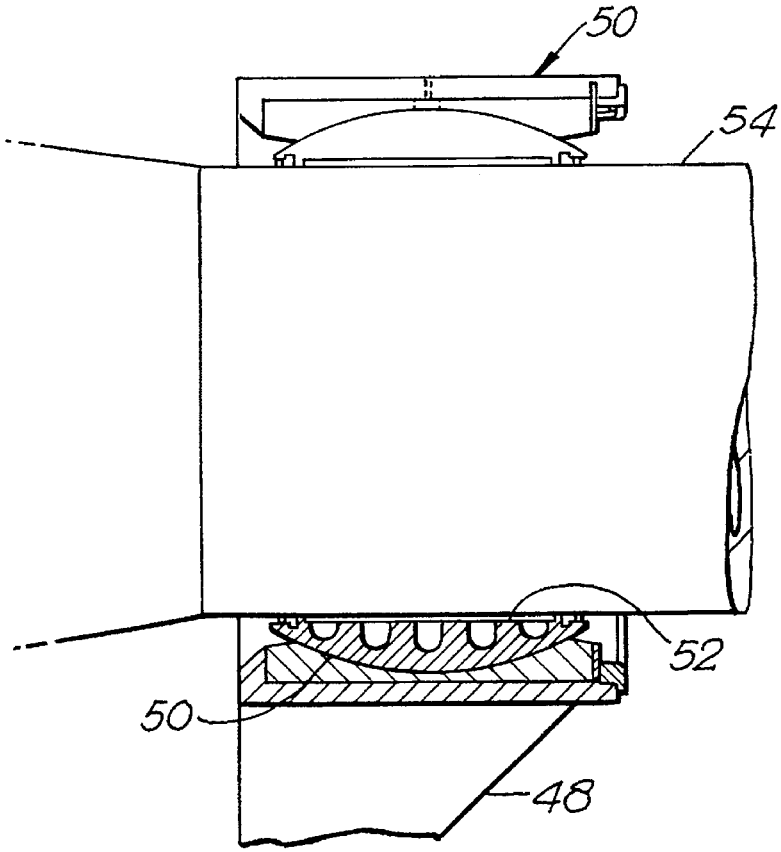
FIG. 6 shows a cross section through the front barrel bearing.
Figure 7A:
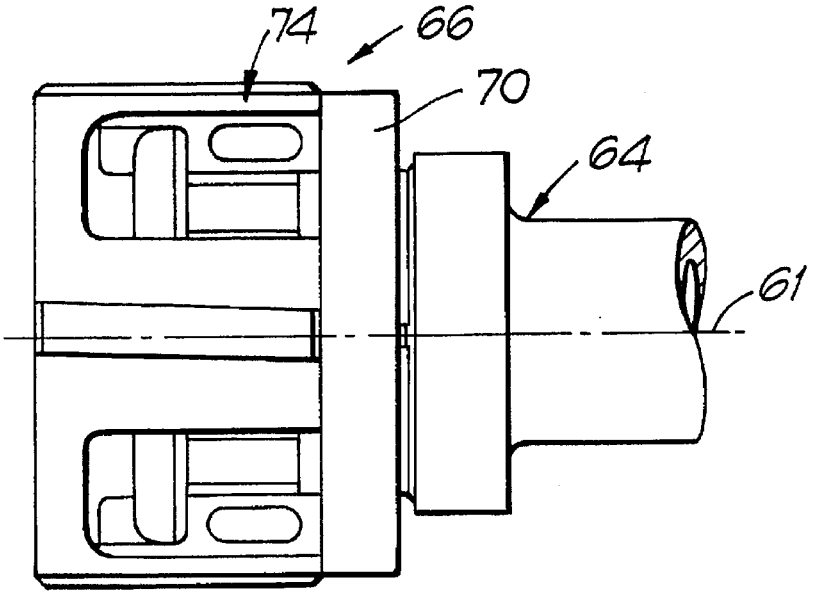
FIGS. 7A and 7B show in more detail than FIG. 5, a side view of the valve assembly and a cross section therethrough respectively.
Figure 7B:
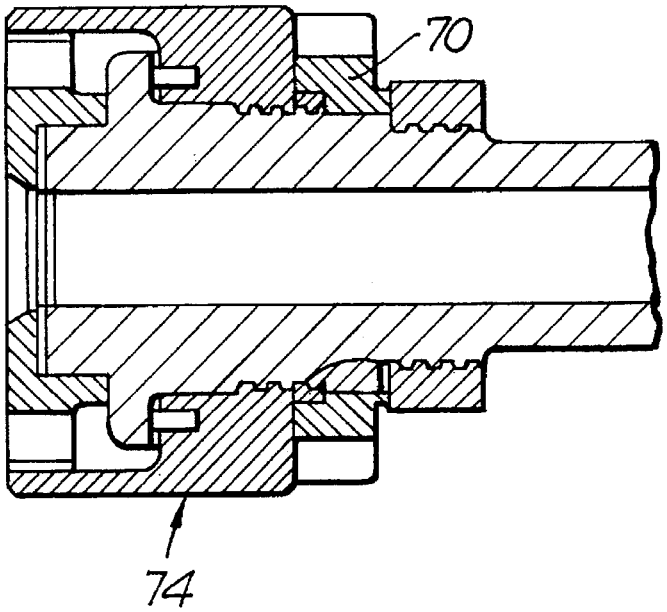
Figure 8A:
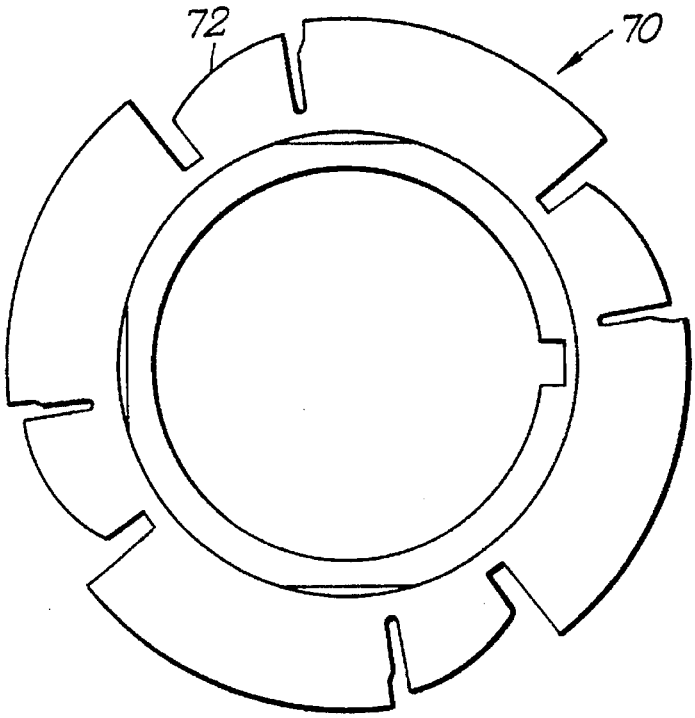
FIGS. 8A and 8B show a front elevation of the first and second valve portions.
Figure 8B:
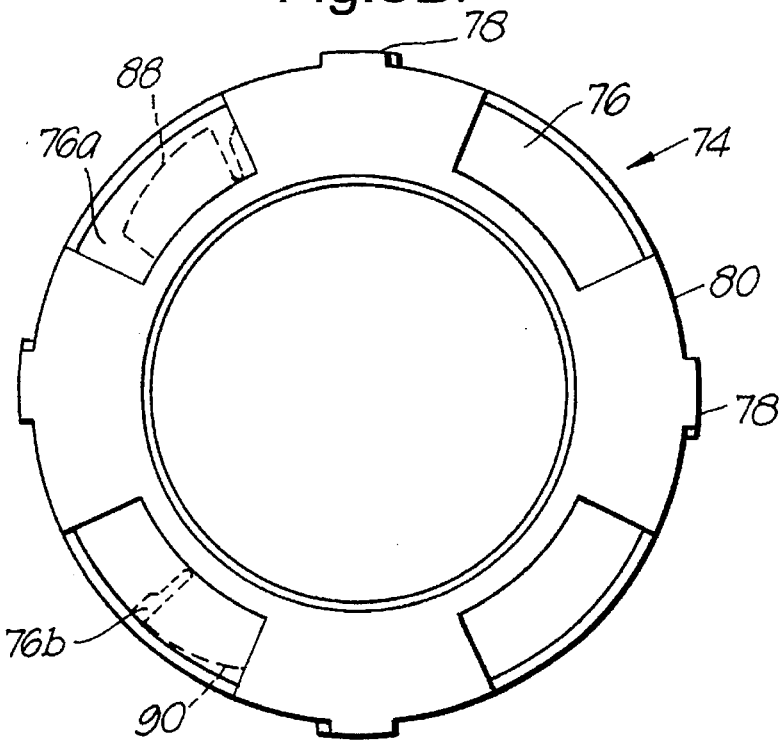
Figure 9A:
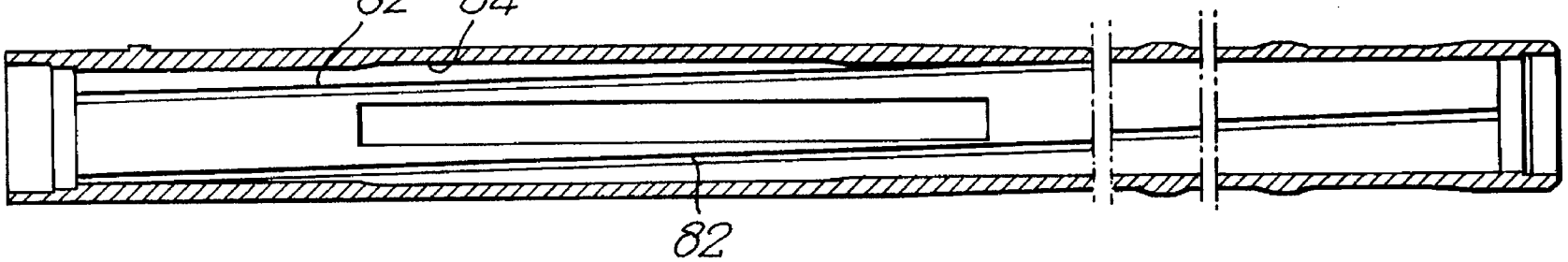
FIGS. 9A and 9B show an axial and a radial cross section through the recoil cylinder alone, respectively.
Figure 9B:
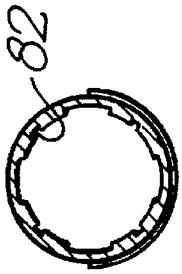

A 155 mm light towed howitzer-type gun is shown generally in FIGS. 1 and 2. The gun comprises trail arm assemblies 10 connected to a lower carriage 12, an upper carriage 14 on the lower carriage 12, wheels 16 on the lower carriage, a cradle 18 pivoted to the upper carriage at 20 and a barrel and recoil brake assembly 22 movably supported by the cradle 18. The cradle 18 and the barrel and recoil brake assembly may be moved about the pivot 20 by hydraulic rams 24 so as to change the angle of elevation of the cradle, barrel and recoil brake assembly 22.

The barrel and recoil brake assembly is movably supported in the cradle 18 such that on firing of a round of ammunition, the barrel is able to recoil relative to the cradle 18 in the direction right to left as seen in FIGS. 1 and 2 for example. The barrel and recoil brake assembly 22 comprises a gun barrel 30, a recoil cylinder 32 in fixed relationship to the barrel 30, a breech 34 at one end of the barrel for loading ammunition rounds in known manner, a muzzle 36 at the remote end of the barrel, a recuperator cylinder 38 for returning the barrel to its initial firing position after recoiling and a pair of curvilinear recoil tracks 40 of channel-shaped cross section at the breech end in fixed relationship to the barrel 30.

The barrel and recoil brake assembly 22 is supported in the cradle 18 by means of two pairs of roller axles 42 which run in the channel-shaped curvilinear recoil tracks 40, the roller axles 42 being fixed to the cradle inner walls 44 of the side rails 46 which constitute part of the cradle 18. At the front end of the cradle 18 is a cross member 48 which joins the two side rails 46. The cross member 48 houses a spherical bearing 50 which can rotate relative to the cross member 48 and cradle 18. The bearing 50 has a bore 52 which receives an intermediate part 54 of the barrel 30; this intermediate par 54 having a cylindrical cross section and is able to slide in the bore 52 under recoil conditions (see FIG. 6). Thus, during recoil, the barrel and recoil brake assembly moves from right to left as seen in FIGS. 1 and 2, the breech end 34 of the barrel 30 riding in an upwardly direction by virtue of the tracks 40 and roller axles 42 and the barrel part 54 sliding linearly in the bore 52 of the spherical bearing 50 which rotates to allow the barrel 30 to pivot about the centre of the bearing 50. Therefore, at the end of recoil travel after firing as shown in FIG. 1, the breech end of the barrel is at higher position than that initially before firing and the muzzle 36 is at a lower position than that initially, where overall, the centre of gravity of the recoil mass is raised higher than its initial position.

Recoil distance is controlled by the recoil brake assembly which comprises the recoil cylinder 32 which has a piston rod 60 which is connected at its forward end by a second spherical bearing 62 to the cross member 48 and at its rear end 64 to a piston formed by a valve assembly 66, shown in FIGS. 5, 7, 8 and 9. The piston rod slides in a gland seal 68 which prevents fluid loss. The rear end 64 of the piston rod is rigidly connected to a first valve portion 70, the radial rotational position of which is dictated by the rotational position of the piston rod 60 about its axis 61 which in turn is dictated by the camming means, axial adjusting member and linkage which will be described in detail later with particular respect to FIGS. 10 and 11. The first valve portion 70 has valve port profiles 72 which allow the passage of hydraulic fluid. Relatively rotatably connected to the piston rod end 64 and to the first valve portion 70 is a second valve portion 74 which also has valve port areas 76 and pegs 78 on its outer circumference 80 which are arranged to run in helical grooves 82 (not shown in FIG. 5) formed in the bore 84 of the recoil cylinder 32. Therefore, the rotational radial position of the second valve portion 74 is dictated by its longitudinal axial position within the recoil cylinder bore 84 by virtue of the helical grooves 82.

When the barrel 30 is at low angles of elevation such as is shown in FIG. 1, a long recoil distance is allowable. Conversely, when the barrel 30 is at a high angle of elevation, i.e. pointing upwards, a short recoil distance is needed to prevent the breech 34 from striking the ground and to obviate the need to dig a recoil pit. Thus, when the barrel is in a substantially horizontal position or at a low angle of elevation, the port profile 72 of the first valve member 70 and the port area 76 of The second valve member 74 substantially fully coincide, as shown by the dashed line 88 in FIG. 8B in one of the ports 76*a*. The radial rotational position of the second valve member 74 is determined by its axial position in the recoil cylinder bore 84, i.e. at the initial firing position, with the piston rod 60 fully inserted into the cylinder 32. In this configuration, the maximum orifice area is available for hydraulic fluid flow as recoil is initiated on firing, i.e. the least resistance to fluid flow. As recoil commences and hydraulic fluid is forced from chamber "A" to chamber "B" of the recoil cylinder through the valve port area by relative movement between the piston/valve assembly 66 and the recoil cylinder 32, the second valve member 74 is constrained to rotate relative to the first valve member 70 by virtue of the pegs 78 running in the grooves 82. Thus, the valve member 74 rotates in the clockwise direction as viewed in FIG. 8B. The position of valve portion 70 is permanently fixed at any given angle of barrel elevation by virtue of being fixed to the piston rod 60. Therefore, as recoil proceeds the available area for fluid flow progressively reduces by virtue of the relative rotation of the two valve portions 70 and 74 until the fluid flow port area is completely closed off, at which point, recoil movement of the barrel is stopped.

At the maximum angle of barrel elevation (not shown) where a short recoil distance is required, the piston rod is automatically rotated about its axis 61 in the anti-clockwise direction by the camming means to be described below. At the initial firing position prior to recoil, the relative positions of the two valve portions 70 and 74 are as shown in port area 76*b* of FIG. 8B by the dashed line 90, the available area for fluid flow being much reduced, i.e. the initial resistance to fluid flow is at a maximum. Thus, as recoil proceeds and the second valve portion 74 rotates in the clockwise direction relative to the first valve portion 70 as described above, the point at which the port area available for fluid flow is completely closed off is reached much sooner after a shorter recoil distance has been travelled and recoil travel is again stopped.

Figure 10:
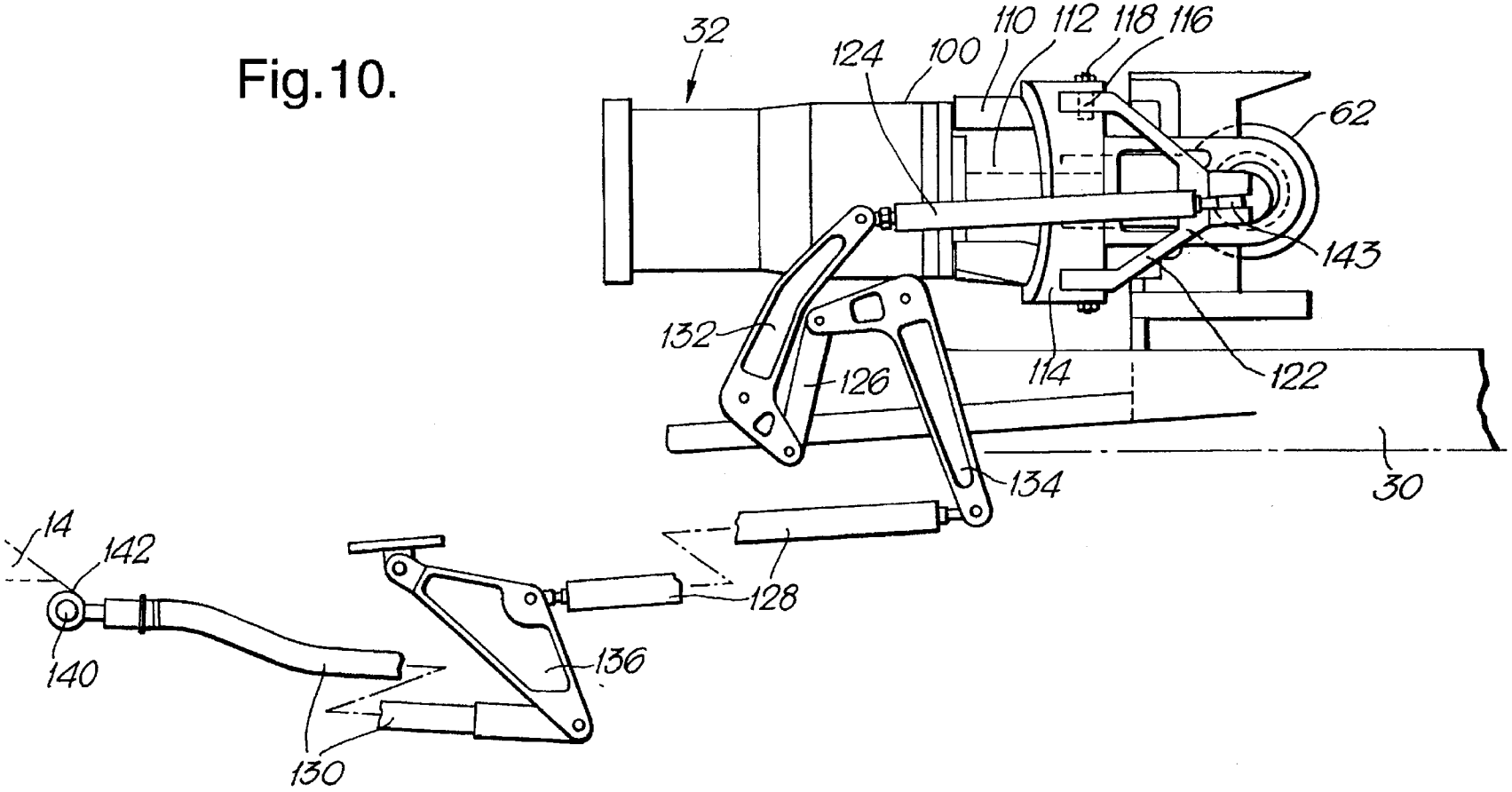
FIG. 10 shows a side view of a first embodiment of camming means and actuating mechanism and linkage.
Figure 11:
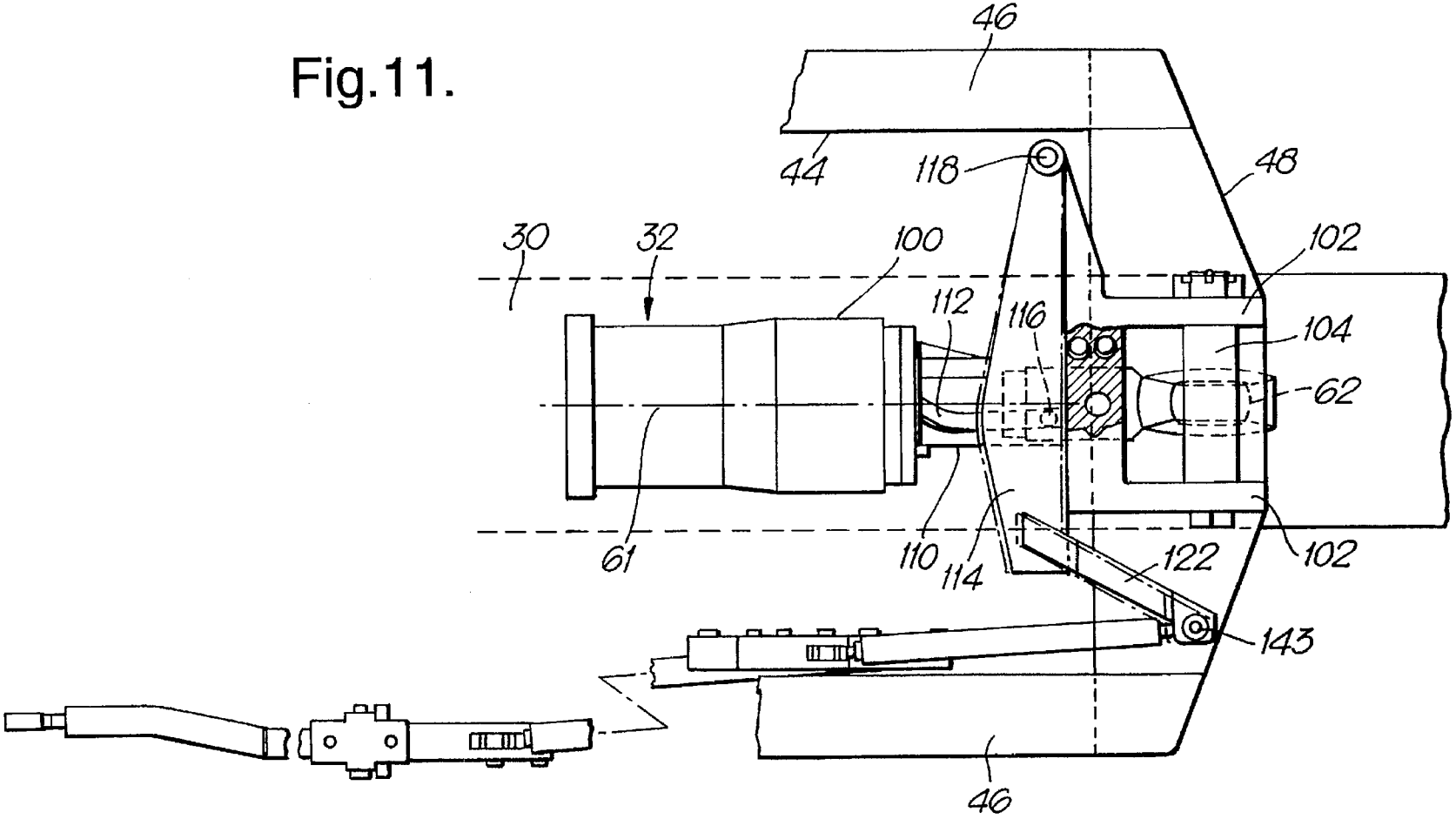
FIG. 11 shows a plan view of the camming means, actuating mechanism and linkage of FIG. 10.

Control of the radial rotational position of the piston rod 60 and first valve portion 70 will now be described with particular reference to FIGS. 10 and 11 which for the purpose of clarity omit much of the detail of the preceding Figures. The end of the recoil cylinder is shown at 100 whilst the end of the piston rod 60 having the spherical bearing 62 is secured to the cross member 48 by a pivot pin 104. The camming means comprises a collar member 110 fixed to the end of the piston rod between the end of the recoil cylinder 100 and the bearing 62. The collar member 110 has a non-linear, rectangular-section groove 112 running in the general axial direction, the path of the groove 112 is predetermined. A yoke member 114 surrounds the collar member 110, the yoke member 114 having a tooth 116 of cooperating rectangular section on the inner surface thereof and running in the groove 112. The yoke 114 is constrained to move about a pivot 118 fixed to a second yoke 102 which pivots about the pivot pin 104 as the recoil cylinder and rod tilt. Thus, the yoke 114 is able to move in the general axial direction about the pivot 118, the tooth 116 being constrained to run in the groove 112. The yoke 114 has an arm 122 fixed thereto. Pivotally connected at 143 to the arm 122 is a system of pushrods 124, 126, 128, 130 and bell cranks 132, 134, 136 the combined effect of which operably connect the yoke 114 and arm 122 to a fixing point 140 at a spherical rod end 142 on the upper carriage 14. The bellcranks 136, 134 and 132 are pivotally fixed to one of the cradle side rails 46, and joined by the pushrods 130, 128 126 and 124 to the arm 122 such that as the cradle 18 carrying the gun barrel and recoil brake assembly 22 is elevated relative to the upper carriage 14, the yoke member 114 is caused to move in a generally axial direction rearwardly about the pivot 118. Since the tooth 116 is constrained to run in the groove 112, the combined effect of the non-linear groove path and the arc described about the pivot 118 by the yoke 114 is to cause the collar member 110 to rotate with the piston rod about the axis 61 in a predetermined and controlled manner in accordance with the angle of elevation of the barrel 30, such rotation being allowed by the spherical bearing 62. In practice, as the angle of elevation of the barrel is raised beyond a predetermined point, the path of the tooth 116 causes the collar 110 and hence the piston rod 60 and first valve portion 70 to rotate by a predetermined angle about the axis 61 thus changing the initial port area between the first and second valve portions.

At low barrel elevations, the pivot 143, joining the arm 122 to the actuating linkage system of pushrods and bell cranks described above, is at a position which is coaxial with that of the pivot pin 104 about which the second yoke member 102 and the piston rod 60 pivot. Therefore when the ordnance recoils up the curvilinear tracks 40 and causes the recoil cylinder and rod to tilt, there results only a negligible motion (or back-driving) of the linkage.

A particular advantage of the present invention is that the high hydraulic pressure which is generated in chamber "A" during recoil and applied to the axially directed side faces of the valve port profile 72, thus causing a net turning torque on the piston rod, is resisted by the tooth 116 in the groove 112 of the collar 110. The yoke 114 in which the tooth 116 is fixed is rigidly supported by the yoke 102 and the pivot pin 104 so as to be able to prevent the majority of the turning torque which is imposed by the hydraulic pressure being passed to the actuation linkage. In known prior art arrangements, the turning torque was resisted only by for example, a system of pushrods and bellcranks such as are used to move the yoke in the generally axial direction. In these known systems, the linkage would wear at a high rate producing inaccurate and unreliable control of the recoil distance with barrel elevation due to lost motion and deflection of insufficiently rigid members.

A further particular feature of the present invention is that at low elevation firing, i.e. long recoil and maximum recoil cylinder and piston rod pivoting, the position of the camming linkage pivot 143, as described above, is such as to incur negligible back-drive loading. As the gun elevation increases, recoil distance is quickly reduced and recoil cylinder pivoting is reduced even faster (since there tends to be proportionally higher rotation of the barrel with recoil distance). Therefore, back-driving of the linkage is in any event less likely.

A further feature of the present invention is that under recoil conditions and movement of the piston rod 60 relative to the barrel 30 and recoil cylinder 32, deflection of the piston rod occurs. This deflection is caused due to the fact that the barrel 30 rotates about the centre of the spherical bearing 50. However, the centre of the spherical bearing 62 is not coincident with the centre of bearing 50. Therefore, as the barrel 30 recoils, the axes of the barrel and that of the piston rod 60 tend to converge slightly causing the piston rod to bend about the gland seal 68. The piston rod deflection is greatest at maximum recoil distance, i.e. at low angles of elevation, and least at short recoil distances, i.e. at high angles of barrel elevation. Allowing for such deflection intentionally, has removed the need for complex mechanical linkages to compensate for the geometrical convergence of the two axes.

Figure 12:
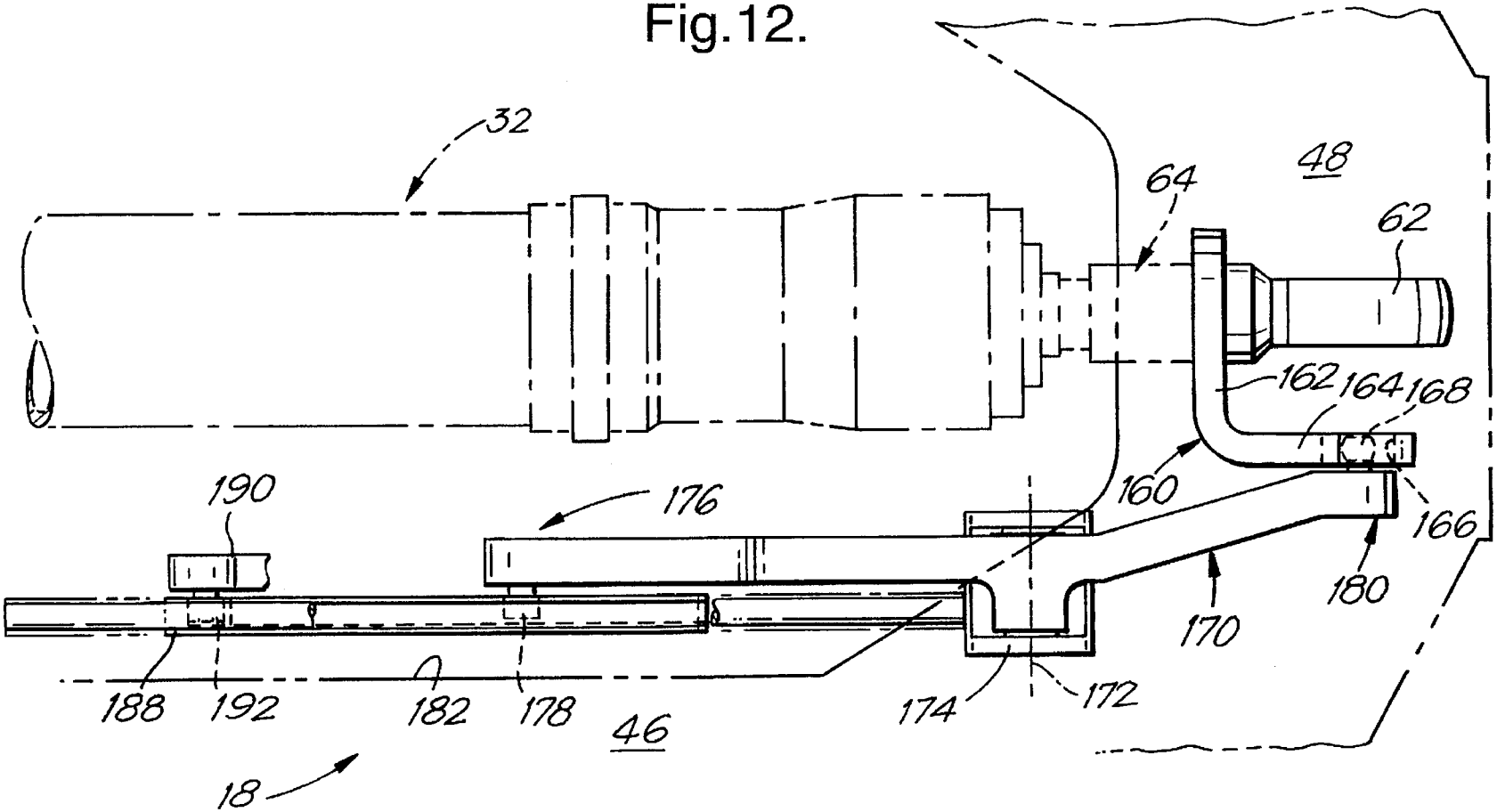
FIG. 12 shows a plan view of a second embodiment of camming means, control means and linkage.
Figure 13:
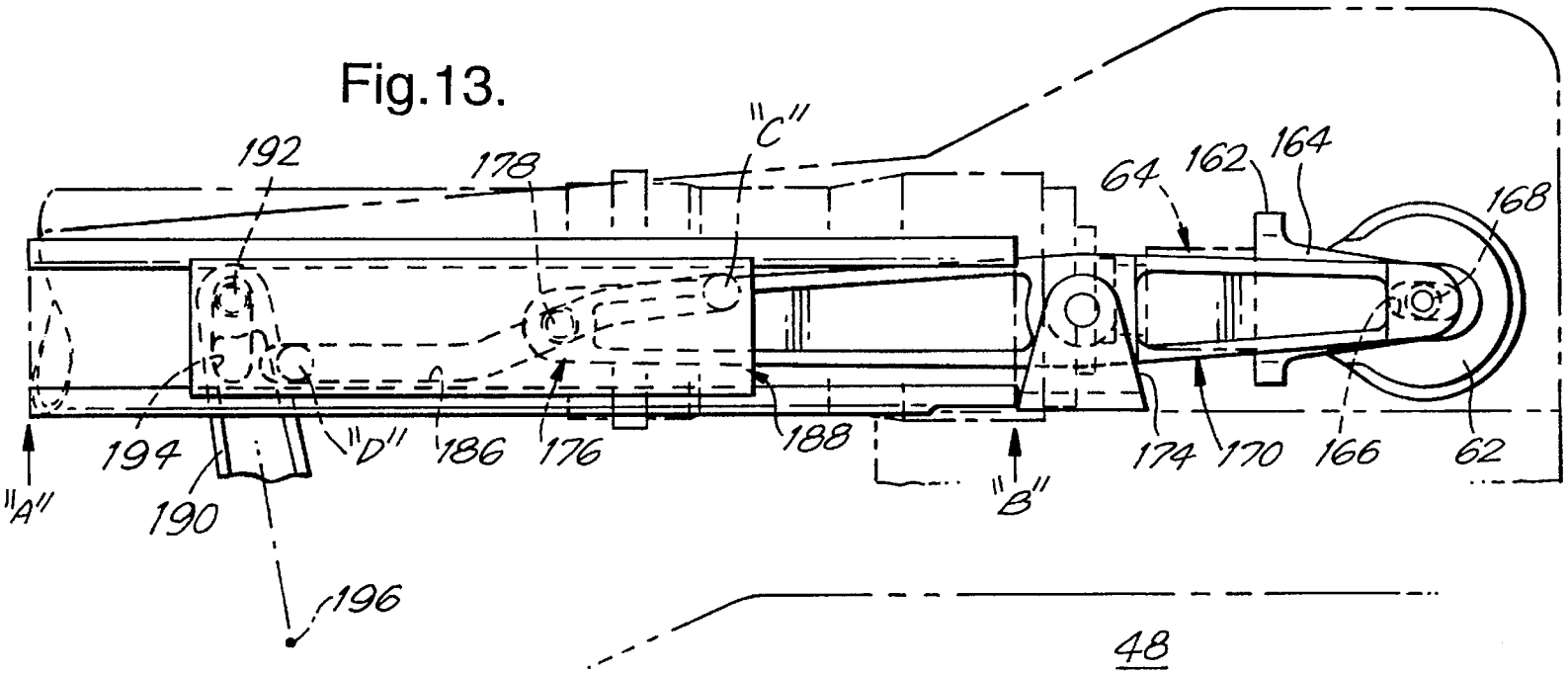
FIG. 13 shows a side view of the embodiment of FIG. 12.
Figure 14:
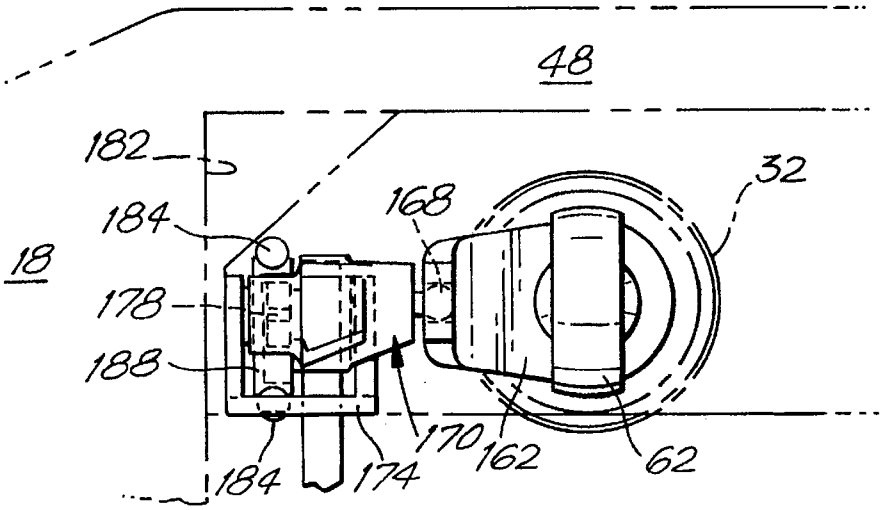
FIG. 14 which shows an end view of the embodiment shown in FIGS. 12 and 13.

Referring now to FIGS. 12 to 14 of the drawings and where common features are denoted by common reference numerals, the Figures showing a second embodiment of camming and control means according to the present invention.

As in the previous embodiment, a recoil cylinder 32 having a piston rod 64 which is fixed on a cross member 48 of a cradle 18 by a spherical bearing 62 are shown. However, in place of the generally cylindrical camming collar member 110 is a member 160 having a crank arm portion 162 and cooperating arm portion 164 in fixed relationship to the end of the piston rod 64. The cooperating arm 164 has a slot 166 in which is received a ball joint portion 168. The ball joint portion 168 is fixed to a lever arm 170 which is pivoted about an axis 172 on a bracket 174 fixed to the cradle 18. The lever arm 170 has a first end 176 having a roller bearing follower member 178 rotatably mounted thereon, the second end 180 has the ball joint portion 168 mounted thereon. A cam plate member 188 is slidably mounted on the inner face 182 of a cradle side rail member 46, the cam plate member 188 being slidably supported on two guide rails 184 fixed to the inner face 182 of the side rail 46. The cam plate member 188 has a non-linear cam groove profile 186 formed therein, the follower member 178 of the lever arm 170 being received therein. The axial position of each end of the cam plate member 188 relative to the cradle 18 (and the barrel 22) is determined by the elevational position of the barrel 22 and lies between a position "A" of the left hand end, as viewed in FIG. 13, when the barrel is substantially horizontal, and position "B" of the right hand end, as viewed in FIG. 13, when the barrel muzzle is at maximum elevation (the relative positions of the follower 178 in the cam groove profile 186 are indicated at "C" and "D" for these two extremes, respectively). The axial position of the cam plate member 188 is held by a second lever arm 190 which has a pin 192 running in a vertical groove 194 in the cam plate member 188, the second lever arm 190 being pivoted about an axis at 196 and being positionally controlled by a linkage ultimately connected to the gun carriage 14, similar to that described with reference to the preceding FIGS. 10 and 11, in response to the angle of elevation of the barrel.

Since the roller follower 178 is constrained to run in the cam plate profile 186, the position of the lever arm 170 is thereby controlled as is the rotational position of the crank arm 162 and hence the piston rod 64. Thus, the rotational position of the piston rod 64 is governed by the axial position of the cam plate member 188, the position of which in turn is governed by the angle of elevation of the barrel. The operation of the valve members 70, 74 in the recoil cylinder 32 is identical to that described above with reference to FIGS. 7 to 11.

As before, the rotational position of the piston rod and hence control of the recoil distance is rigidly controlled, in this embodiment, by the member 160, the lever 170 and the cam plate member 188 giving accurate control of recoil distance.

We claim:

1. A recoil system for controlling the recoil distance of a gun barrel according to angle of elevation of the barrel, the barrel having breech means at one end and a muzzle at the other end, the barrel being movably supported during recoil travel on a cradle adjacent its breech end by curvilinear track means and by bearing means intermediate the breech means and the muzzle, the cradle being supported on carriage means such that the angle of elevation of the barrel may be changed, the recoil system comprising:

a recoil cylinder in fixed relationship to the barrel and movable therewith;

valve means within said recoil cylinder, said valve means being adjustable so as to vary the area of an orifice through which a fluid is forced under recoil conditions;

one end of a piston rod operably connected to said valve means so as to cause fluid to pass through said orifice under recoil travel;

the remote end of said piston rod being maintained in a substantially axially stationary position relative to said cradle;

said piston rod being controllably rotatable about its axis;

part of said piston rod being situated outside said recoil cylinder and being operably connected to camming means for controlling the rotational position of the piston rod and hence said valve means orifice area;

said camming means having its position determined by control means, said control means being positionally responsive in the axial direction, relative to said cradle, to barrel elevation and preventing movement of said camming means during recoil movement; and means associated with said recoil cylinder to further control the area of said orifice in response to recoil distance, wherein the bearing means intermediate the breech end and muzzle is a spherical bearing in which a cylindrical portion of the barrel slides during recoil movement.

2. A recoil system according to claim 1 wherein the camming means comprises a generally cylindrical member in fixed relationship to the piston rod, the member having a groove therein which defines a non-linear and non-axial path relative to the piston rod.

3. A recoil system according to claim 2 wherein the rotational position of the member is controlled by a rigid tooth which engages with the groove and is axially movable in a predetermined manner relative to the groove.

4. A recoil system according to claim 2 wherein the precise form of the non-linear and non-axial groove controls the degree of piston rod rotation in response to barrel elevation.

5. A gun having the recoil system of claim 1.

6. A recoil system for controlling the recoil distance of a gun barrel according to angle of elevation of the barrel, the barrel having breech means at one end and a muzzle at the other end, the barrel being movably supported during recoil travel on a cradle adjacent its breech end by curvilinear track means and by bearing means intermediate the breech means and the muzzle, the cradle being supported on carriage means such that the angle of elevation of the barrel may be changed, the recoil system comprising:

a recoil cylinder in fixed relationship to the barrel and movable therewith;

valve means within said recoil cylinder, said valve means being adjustable so as to vary the area of an orifice through which a fluid is forced under recoil conditions;

one end of a piston rod operably connected to said valve means so as to cause fluid to pass through said orifice under recoil travel;

the remote end of said piston rod being maintained in a substantially axially stationary position relative to said cradle;

said piston rod being controllably rotatable about its axis;

part of said piston rod being situated outside said recoil cylinder and being operably connected to camming means for controlling the rotational position of the piston rod and hence said valve means orifice area;

said camming means having its position determined by control means, said control means being positionally responsive in the axial direction, relative to said cradle, to barrel elevation and preventing movement of said camming means during recoil movement; and means associated with said recoil cylinder to further control the area of said orifice in response to recoil distance, wherein the valve means are axially movable relative to the recoil cylinder and comprise a first valve portion, the position of which is controlled by the rotational position of the piston rod; and a second valve portion rotatable relative to the first valve portion and having its rotational position dictated by its axial position in the recoil cylinder, the relative rotational positions of the first and second valve portions controlling the area of the fluid flow orifice therebetween.

7. A recoil system according to claim 2 wherein the second valve portion has pegs protruding radially from the circumference thereof, said pegs slidably engaging with helically formed grooves in the bore of the recoil cylinder such that the longitudinal axial position of the second valve portion in the recoil cylinder dictates its rotational position relative to the first valve portion.

8. A recoil system according to claim 3 wherein the valve means are associated with a piston member but free to rotate relative thereto subject to the rotational constraints of the piston rod on the first valve portion and on the peg and groove arrangement.

9. A recoil system according to claim 6, wherein the camming means comprises a generally cylindrical member in fixed relationship to the piston rod, the member having a groove therein which defines a non-linear and non-axial path relative to the piston rod.

10. A recoil system according to claim 9, wherein the rotational position of the member is controlled by a rigid tooth which engages with the groove and is axially movable in a predetermined manner relative to the groove.

11. A recoil system according to claim 10, wherein the precise form of the non-linear and non-axial groove controls the degree of piston rod rotation in response to barrel elevation.

12. A gun having the recoil system of claim 6.

13. A recoil system for controlling the recoil distance of a gun barrel according to angle of elevation of the barrel, the barrel having breech means at one end and a muzzle at the other end, the barrel being movably supported during recoil travel on a cradle adjacent its breech end by curvilinear track means and by bearing means intermediate the breech means and the muzzle, the cradle being supported on carriage means such that the angle of elevation of the barrel may be changed, the recoil system comprising:

a recoil cylinder in fixed relationship to the barrel and movable therewith;

valve means within said recoil cylinder, said valve means being adjustable so as to vary the area of an orifice through which a fluid is forced under recoil conditions;

one end of a piston rod operably connected to said valve means so as to cause fluid to pass through said orifice under recoil travel;

the remote end of said piston rod being maintained in a substantially axially stationary position relative to said cradle;

said piston rod being controllably rotatable about its axis;

part of said piston rod being situated outside said recoil cylinder and being operably connected to camming means for controlling the rotational position of the piston rod and hence said valve means orifice area;

said camming means having its position determined by control means, said control means being positionally responsive in the axial direction, relative to said cradle, to barrel elevation and preventing movement of said camming means during recoil movement; and means associated with said recoil cylinder to further control the area of said orifice in response to recoil distance, wherein the camming means comprises a generally cylindrical member in fixed relationship to the piston rod, the member having a groove therein which defines a non-linear and non-axial path relative to the piston rod, wherein the rotational position of the member is controlled by a rigid tooth which engages with the groove and is axially movable in a predetermined manner relative to the groove, wherein the tooth is mounted on control means comprising a yoke which surrounds the generally cylindrical member.

14. A recoil system according to claim 13 herein a pivot point between said yoke and said linkage lies substantially in the same axis as the pivot axis of the piston rod fixing on the cradle when the barrel is at low angles of elevation.

15. A recoil system according to claim 14 herein said pivot point between said yoke and said linkage is gradually displaced from the pivot axis of said piston rod fixing as said barrel elevation increases.

16. A recoil system according to claim 13 wherein the yoke member is pivotally connected to the cradle and constrained to move in the axial direction relative to the piston rod under the action of a linkage between the carriage and the barrel, the linkage changing the axial position of the rigid tooth member in accordance with barrel elevation.

17. A gun having the recoil system of claim 13.

18. A recoil system for controlling the recoil distance of a gun barrel according to angle of elevation of the barrel, the barrel having breech means at one end and a muzzle at the other end, the barrel being movably supported during recoil travel on a cradle adjacent its breech end by curvilinear track means and by bearing means intermediate the breech means and the muzzle, the cradle being supported on carriage means such that the angle of elevation of the barrel max be changed, the recoil system comprising:

a recoil cylinder in fixed relationship to the barrel and movable therewith;

valve means within said recoil cylinder, said valve means being adjustable so as to vary the area of an orifice through which a fluid is forced under recoil conditions;

one end of a piston rod operably connected to said valve means so as to cause fluid to pass through said orifice under recoil travel;

the remote end of said piston rod being maintained in a substantially axially stationary position relative to said cradle;

said piston rod being controllably rotatable about its axis;

part of said piston rod being situated outside said recoil cylinder and being operably connected to camming means for controlling the rotational position of the piston rod and hence said valve means orifice area;

said camming means having its position determined by control means, said control means being positionally responsive in the axial direction, relative to said cradle, to barrel elevation and preventing movement of said camming means during recoil movement; and means associated with said recoil cylinder to further control the area of said orifice in response to recoil distance, wherein the camming means comprises a cam plate member having a cam track of non-linear profile, said member being slidable axially with respect to said cradle in response to barrel elevation.

19. A recoil system according to claim 18 wherein said control means comprises a pivotably mounted lever arm, the lever arm having a first end having cam track follower means to follow said cam track profile and a second end operably connected by crank means to said piston rod to change the rotational position thereof in response to barrel elevation.

20. A recoil system according to claim 19 wherein said second end of said lever arm is operably connected to said crank means by a ball joint.

21. A recoil system according to claim 19 wherein said crank means comprises a crank arm in fixed relationship to said piston rod.

22. A recoil system according to claim 21 wherein said second end of said lever arm is operably connected to said crank means by a ball joint.

23. A recoil system according to claim 18 wherein said slidable member is slidably supported on guide rails fixed to said cradle.

24. A gun having the recoil system of claim 18.

* * * * *